US008032377B2

(12) United States Patent
Massimino

(10) Patent No.: US 8,032,377 B2
(45) Date of Patent: Oct. 4, 2011

(54) GRAPHEME TO PHONEME ALIGNMENT METHOD AND RELATIVE RULE-SET GENERATING SYSTEM

(75) Inventor: Paolo Massimino, Turin (IT)

(73) Assignee: Loquendo S.p.A., Turin (IT)

( * ) Notice: Subject to any disclaimer, the term of this patent is extended or adjusted under 35 U.S.C. 154(b) by 1342 days.

(21) Appl. No.: 10/554,956

(22) PCT Filed: Apr. 30, 2003

(86) PCT No.: PCT/EP03/04521

§ 371 (c)(1),
(2), (4) Date: Oct. 28, 2005

(87) PCT Pub. No.: WO2004/097793

PCT Pub. Date: Nov. 11, 2004

(65) Prior Publication Data

US 2006/0265220 A1 Nov. 23, 2006

(51) Int. Cl.
*G10L 13/08* (2006.01)
*G10L 13/06* (2006.01)

(52) U.S. Cl. ..... 704/260; 704/266

(58) Field of Classification Search ..... 704/260, 704/263, 266, 267, 235, 243
See application file for complete search history.

(56) References Cited

U.S. PATENT DOCUMENTS 5,781,884 A * 7/1998 Pereira et al. ..... 704/260
6,134,528 A * 10/2000 Miller et al. ..... 704/258
6,347,295 B1 2/2002 Vitale et al.
6,411,932 B1 * 6/2002 Molnar et al. ..... 704/260
7,107,216 B2 * 9/2006 Hain ..... 704/260
7,171,362 B2 * 1/2007 Hain ..... 704/267
7,406,417 B1 * 7/2008 Hain ..... 704/260
2002/0049591 A1 4/2002 Hain

FOREIGN PATENT DOCUMENTS

DE 199 42 178 C 1 1/2001

OTHER PUBLICATIONS

Mana et al.; "Using Machine Learning Techniques for Grapheme to Phoneme Transcription"; Proceeding of Eurospeech 2001, vol. 3, pp. 1915-1918, (2001).

(Continued)

*Primary Examiner* — Angela A Armstrong
(74) *Attorney, Agent, or Firm* — Finnegan, Henderson, Farabow, Garrett & Dunner, L.L.P.

(57) ABSTRACT

Grapheme-to-phoneme alignment quality is improved by introducing a first preliminary alignment step, followed by an enlargement step of the grapheme-set and phoneme-set, and a second alignment step based on the previously enlarged grapheme /phoneme sets. During the enlargement step, grapheme clusters and phoneme clusters are generated that become members of a new grapheme and phoneme set. The new elements are chosen using statistical information calculated using the results of the first alignment step. The enlarged sets are the new grapheme and phoneme alphabet used for the second alignment step. The lexicon is rewritten using this new alphabet before starting with the second alignment step that produces the final result.

12 Claims, 5 Drawing Sheets

OTHER PUBLICATIONS

Dermatas et al.; "A Language-Independent Probabilistic Model for Automatic Conversion Between Graphemic and Phonemic Transcription of Words"; Proceedings of Eurospeech 1999, vol. 5, pp. 2071-2074, (1999).

Besling; "A Statistical Approach to Multilingual Phonetic Transcription"; Philips J. Res. vol. 49, pp. 367-379, (1995).

Hain; "Automation of the Training Procedures for Neural Networks Performing Multi-Lingual Grapheme to Phoneme Conversion"; Proceedings of Eurospeech 1999, vol. 5, pp. 2087-2090, (1999).

Baldwin et al.; "A Comparative Study of Unsupervised Grapheme-Phoneme Alignment Methods"; Proceedings of the 22nd Annual Meeting of the Cognitive Science Society, pp. 597-602, (2000).

Bosch et al.; "Data-Oriented Methods for Grapheme-To-Phoneme Conversion"; Institute for Language Technology and Al, Tilburg University, The Netherlands, Sixth Conference of the European Chapter of the Association for Computational Linguistics, pp. 45-53, (1993).

* cited by examiner

GRAPHEME TO PHONEME ALIGNMENT METHOD AND RELATIVE RULE-SET GENERATING SYSTEM

CROSS REFERENCE TO RELATED APPLICATION

This application is a national phase application based on PCT/EP2003/004521, filed Apr. 30, 2003, the content of which is incorporated herein by reference.

FIELD OF THE INVENTION

The present invention relates generally to the automatic production of speech, through a grapheme-to-phoneme transcription of the sentences to utter. More particularly, the invention concerns a method and a system for generating grapheme-phoneme rules, to be used in a text to speech device, comprising an alignment phase for associating graphemes to phonemes, and a text to speech system.

BACKGROUND ART

Speech generation is a process that allows the transformation of a string of symbols into a synthetic speech signal. An input text string is divided into graphemes (e.g. letters, words or other units) and for each grapheme a corresponding phoneme is determined. In linguistic terms a "grapheme" is the visual form of a character string, while a "phoneme" is the corresponding phonetic pronunciation.

The task of grapheme-to-phoneme alignment is intrinsically related to text-to-speech conversion and provides the basic toolset of grapheme-phoneme correspondences for use in predicting the pronunciation of a given word. In a speech synthesis system, the grapheme-to-phoneme conversion of the words to be spoken is of decisive importance. In particular, if the grapheme-to-phoneme transcription rules are automatically obtained from a large transcribed lexicon, the lexicon alignment is the most important and critical step of the whole training scheme of an automatic rule-set generator algorithm, as it builds up the data on which the algorithm extracts the transcription rules.

The core of the process is based on a dynamic programming algorithm. The dynamic programming algorithm aligns two strings finding the best alignment with respect to a distance metric between the two strings.

A lexicon alignment process iterates the application of the dynamic programming algorithm on the grapheme and phoneme sequences, where the distance metric is given by the probability P(f|g) that a grapheme g will be transcribed as a phoneme f. The probabilities P(f|g) are estimated during training each iteration step.

In document Baldwin Timoty and Tanaka Hozumi, "A comparative Study of Unsupervised Grapheme-Phoneme Alignment Methods", Dept of Computer Science-Tokyo Institute of Technology, two well-known unsupervised algorithms to automatically align grapheme and phoneme strings are compared. A first algorithm is inspired by the TF-IDF model, including enhancements to handle phonological determine frequency through analysis variation and of "alignment potential". A second algorithm relies on the C4.5 classification system, and makes multiple passes over the alignment data until consistency of output is achieved.

In document Walter Daelemans and Antal Van den Bosch, "Data-oriented Methods for Grapheme-to-Phoneme Conversion", Institute for Language Technology and AI, Tilburg University, NL-5000 LE Tilburg, two further grapheme-to-phoneme conversion methods are shown. In both cases the alignment step and the rule generation step are blended using a lookup table. The algorithms search for all unambiguous one-to-one grapheme-phoneme mappings and stores these mappings in the lookup table.

In U.S. Pat. No. 6,347,295 a computer method and apparatus for grapheme-to-phoneme rule-set-generation is proposed. The alignment and rule-set generation phases compare the character string entries in the dictionary, determining a longest common subsequence of characters having a same respective location within the other character string entries.

In the methods disclosed in the above-mentioned documents, the graphemes and the phonemes belong respectively to a grapheme-set and a phoneme-set that are defined in advance and fixed, and that cannot be modified during the alignment process.

The assignment of graphemes to phonemes is not, however, yielded uniquely from the phonetic transcription of the lexicon. A word having N letters may have a corresponding number of phonemes different from N, since a single phoneme can be produced by two or more letters, as well as one letter can, produce two or more phonemes. Therefore, the uncertainty in the grapheme-phoneme assignment is a general problem, particularly when such assignment is performed by an automatic system.

The Applicant has tackled the problem of improving the grapheme-to-phoneme alignment quality, particularly where there are a different number of symbols in the two corresponding representation forms, graphemic and phonetic. In such cases a coherent grapheme-phoneme association is particularly important, in presence of automatic learning algorithms, to allow the system to correctly detect the statistic relevance of each association.

The Applicant observes that particular grapheme-phoneme associations, in which for example a single letter produces two phonemes, or vice versa, may recur very often during the alignment process of a lexicon.

The Applicant has determined that, if such particular grapheme-phoneme associations are identified during the alignment process and treated accordingly in a coherent and well defined manner, such alignment can be particularly precise.

In view of the above, it is an object of the invention to provide a method of generating grapheme-phoneme rules comprising a particularly accurate alignment phase, which is language independent and is not bound by the lexical structures of a language.

SUMMARY OF THE INVENTION

According to the invention that object is achieved by means of a method of generating grapheme-phoneme rules comprising a multi-step alignment phase.

The invention improves the grapheme-to-phoneme alignment quality introducing a first preliminary alignment step, followed by an enlargement step of the grapheme-set and phoneme-set, and a second alignment step based on the previously enlarged grapheme/phoneme sets. During the enlargement step grapheme clusters and phoneme clusters are generated that become members of a new grapheme and phoneme set. The new elements are chosen using statistical information calculated using the results of the first alignment step. The enlarged sets are the new grapheme and phoneme alphabet used for the second alignment step. The lexicon is rewritten using this new alphabet before starting with the second alignment step that produces the final result.

BRIEF DESCRIPTION OF THE DRAWINGS

The invention will now be described, by way of example only, with reference to the annexed figures of drawing, wherein.

DETAILED DESCRIPTION OF A PREFERRED EMBODIMENT OF THE INVENTION

Figure 1:
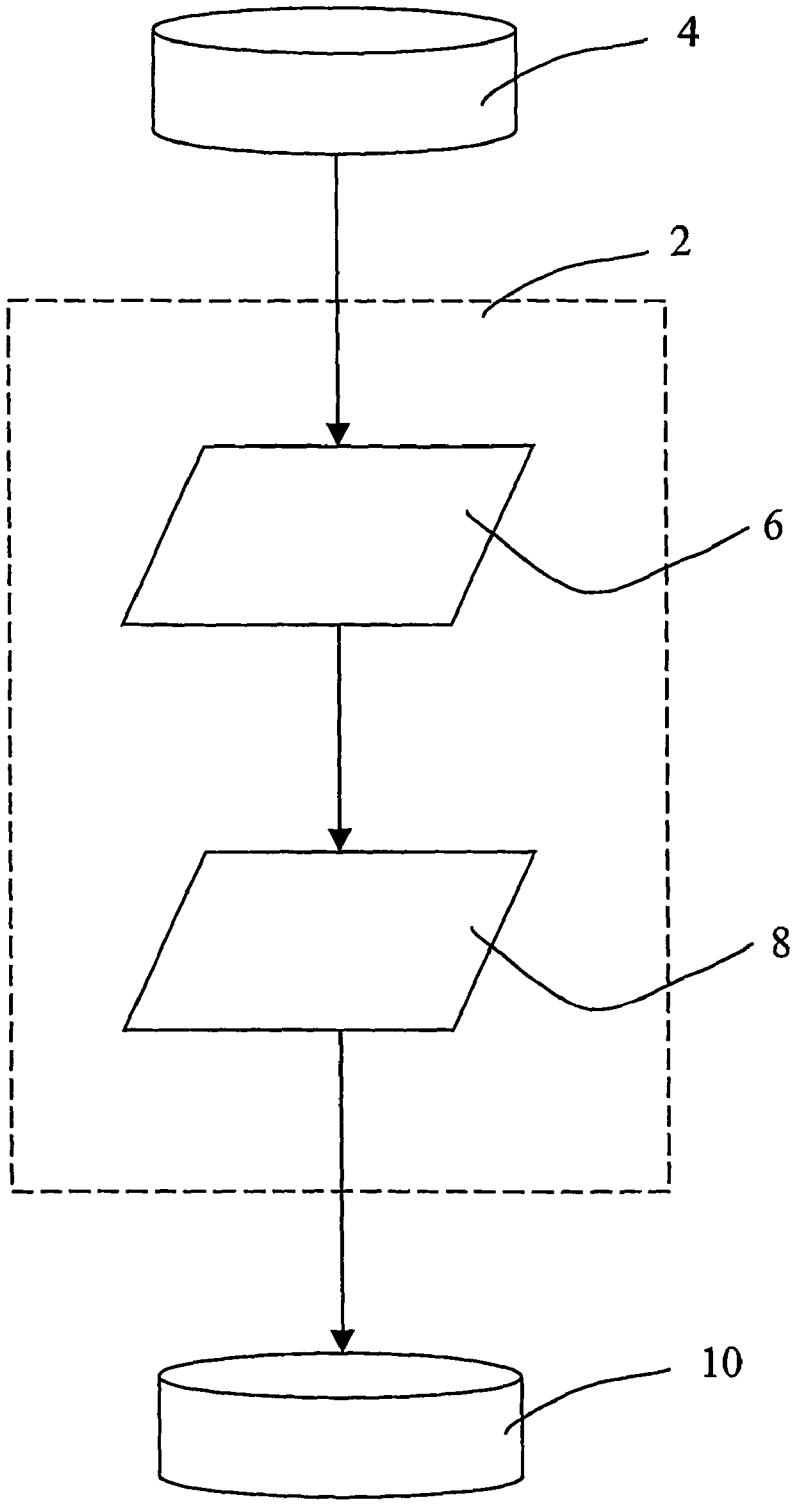
FIG. 1 is a block diagram of a system in which the present invention may be implemented.

With reference to FIG. 1, a device 2 for generating a rule-set 10, reads and analyses entries into an input lexicon 4 and generates a set 10 of grapheme-phoneme rules. The device 2 may be, for example, a computer program executed on a processor of a computer system, implementing a method of generating grapheme-phoneme rules according to the present invention.

The lexicon input 4 comprises a plurality of entries, each entry being formed by a character string and a corresponding phoneme string indicating pronunciation of the character string. By analysing each entry's character string pattern and corresponding phoneme string pattern in relation to character string-phoneme string patterns in other entries, the method is able to create grapheme to phoneme rules for a text-to-speech synthesizer, not shown in figure. A text-to-speech synthesizer uses the generated rule-set 10 to analyse an input text containing character strings written in the same language as the lexicon 4, for producing an audible rendition of the input text.

The device 2 comprises two main blocks, connected in series between the input lexicon 4 and the generated output rule-set 10, an alignment block 6 for the assignment of phonemes to graphemes generating them in the lexicon 4, and a rule-set extraction block 8 for generating, from an aligned lexicon, the rule-set 10 for automatic grapheme to phoneme conversion.

The present invention provides in particular a new method of implementing the grapheme-to-phoneme alignment block 6.

Figure 2:
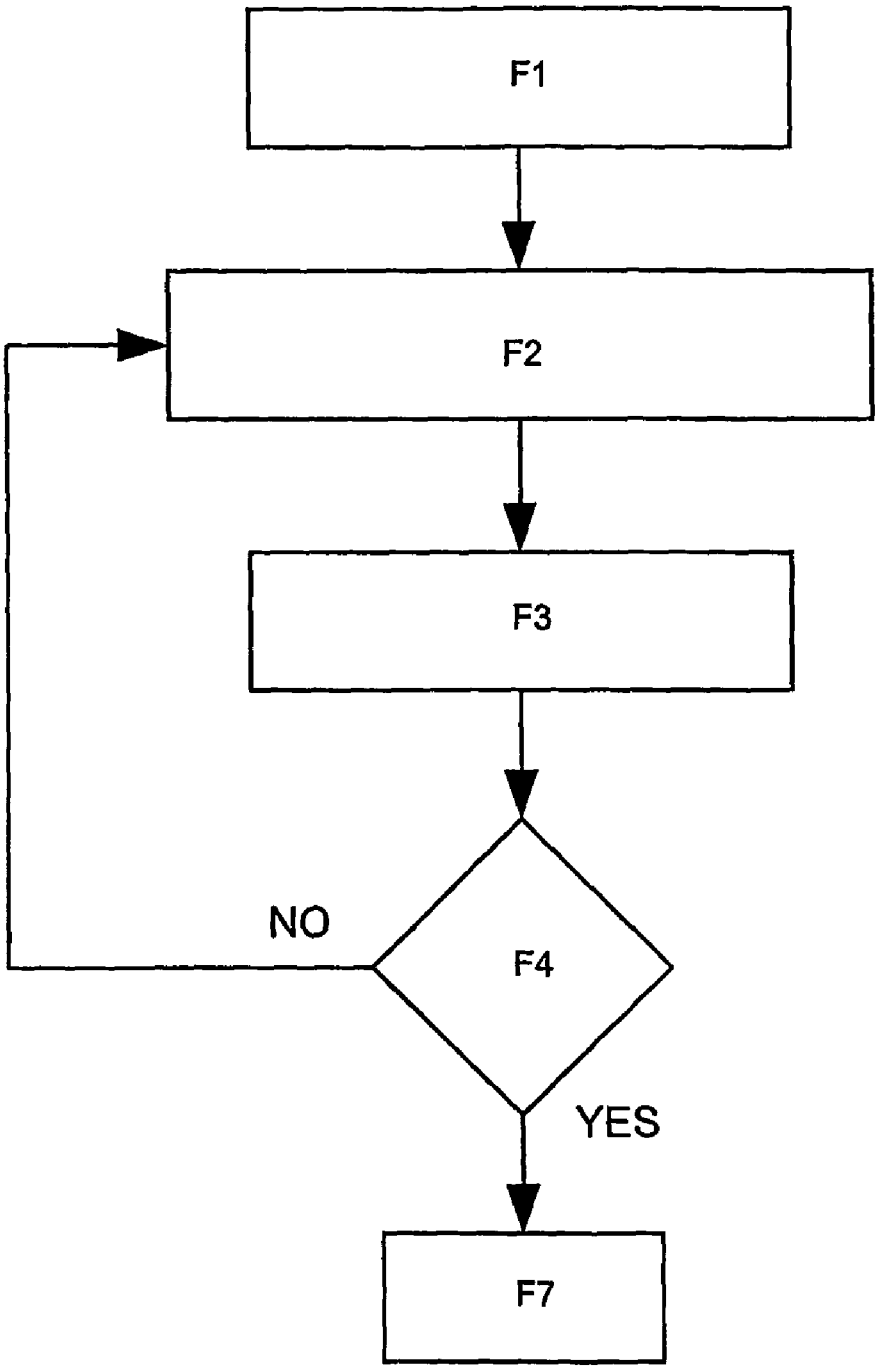
FIG. 2 is a block flow diagram of an alignment method according to the present invention.

The block flow diagram in FIG. 2 shows the main structure of the alignment method implemented in block 6.

A first block F1, explained in detail hereinbelow with reference to FIG. 3, implements a preliminary alignment step, which generates a plurality of grapheme and phoneme clusters, each cluster comprising a sequence of at least two components. A subsequent block F2, explained in detail hereinbelow with reference to FIG. 5, implements a step of enlargement of the grapheme-set and phoneme-set, using said grapheme and phoneme clusters, and a step of rewriting the lexicon according to the new grapheme and phoneme sets.

The block F3, following block F2, implements a second alignment step on the lexicon which has been rewritten with the new graphemic and phonetic sets. Such second step of the lexicon alignment process is quivalent to the preliminary alignment step F1.

The grapheme-set/phoneme-set enlargement step F2 and the second alignment step F3 can be looped several times, see decision block F4 in FIG. 2, until the obtained alignment is considered stable enough. In block F4 the system calculates a statistical distribution of grapheme and phoneme clusters generated in the second alignment step F3 and repeats the execution of blocks F2, F3 in case the number of the generated grapheme and phoneme clusters is greater then a predetermined threshold THR3, whose value can be, for example, an absolute value between 2 and 6.

Generally, a single pass of blocks F2, F3 is satisfactory for improving greatly the quality of the alignment. Block F7 represents the end of the improved alignment process.

Figure 3:
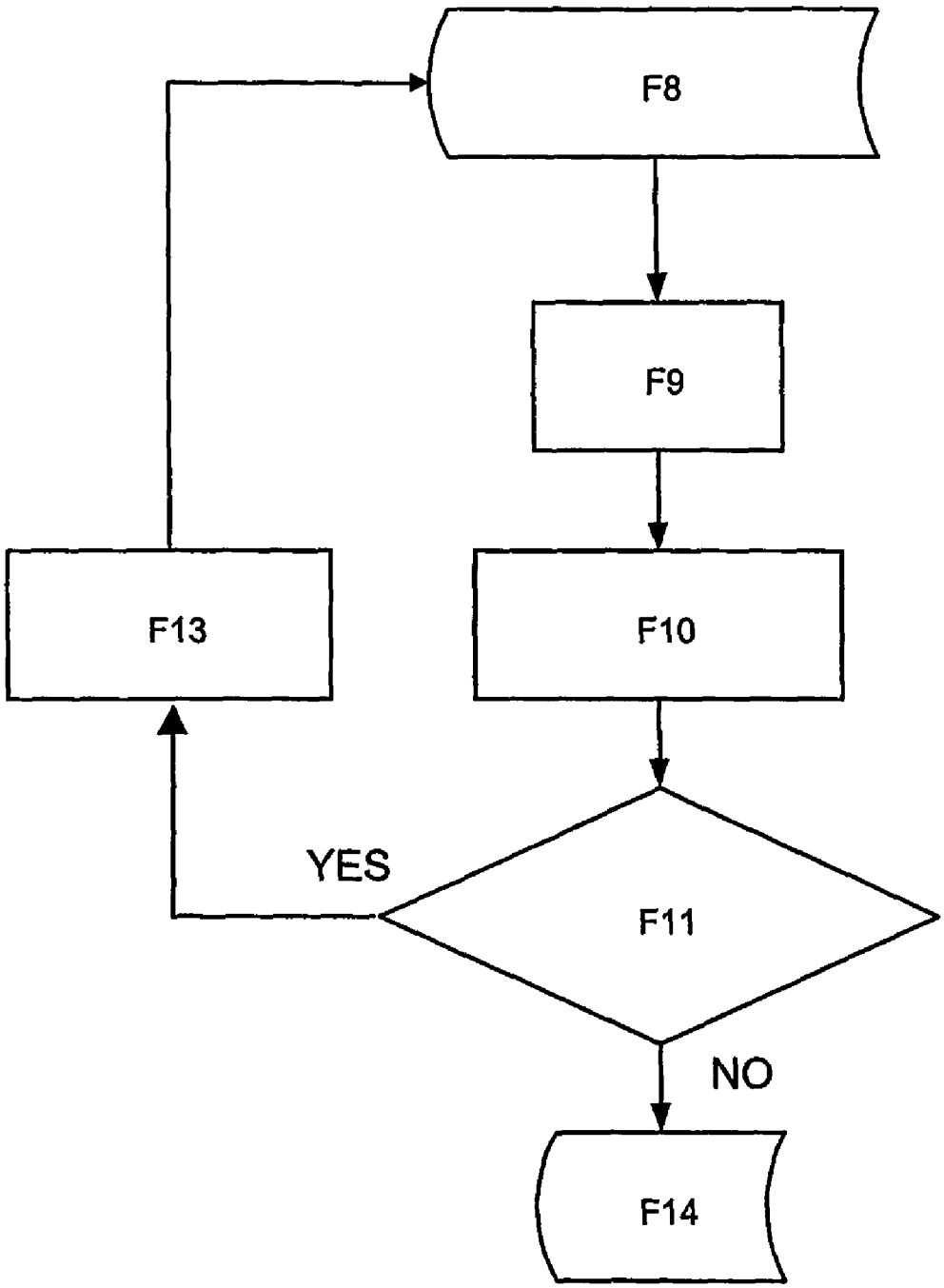
FIG. 3 is a block flow diagram of a first alignment step of the alignment method of FIG. 2.

FIG. 3 illustrates a flow diagram of the preliminary alignment step F1.

The process starts in block F8 using the starting lexicon 4 as data source. The lexicon, which is composed by a set of pairs <grapheme form>=<phoneme form> for each word, is compiled and prepared for the following alignment.

In block F9 is performed the alignment, followed by blocks F10-F11 in which some grapheme clusters and phoneme clusters, whose occurrence is higher then a predetermined threshold (THR1 for grapheme clusters and THR2 for phoneme clusters), are selected. The values of the thresholds THR1 and THR2 depend on the size of the lexicon. An absolute value for these thresholds can be, for example, a value around 5.

In block F10 the system calculates a statistical distribution of potential grapheme and phoneme clusters generated in the lexicon alignment step F9, for selecting, among said potential grapheme and phoneme clusters a cluster having highest occurrence. If such occurrence is higher then a threshold THR4, the lexicon is recompiled with the enlarged grapheme/phoneme sets, block F13, replacing each sequence of components corresponding to the sequence of components of the selected cluster with the selected cluster, and the process is reiterated starting from F8; otherwise the loop ends in block F14.

The potential grapheme and phoneme clusters are individuated searching all grapheme or phoneme cancellations or insertions, that is where there are a different number of symbols in the two corresponding representation forms, graphemic and phonetic.

Figure 4:
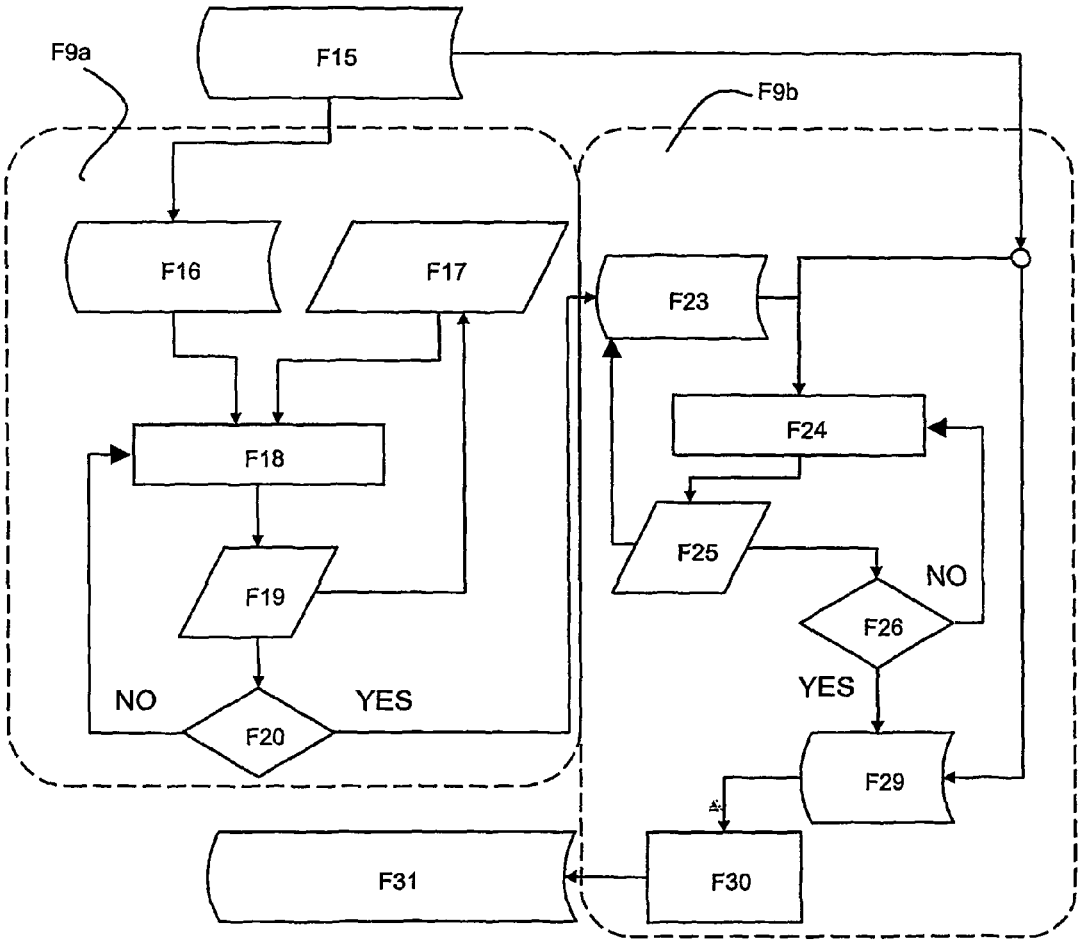
FIG. 4 is a detailed flow diagram of step F9 of the first alignment step of FIG. 3.

FIG. 4 shows in detail the alignment process of block F9 in FIG. 3.

The process starts from the lexicon F15, corresponding to a plurality of pairs <grapheme form>=<phoneme form> for each word, such pairs being well-known as "tuples". The process is divided in two sub-blocks, a first loop F9*a* and a second loop F9*b*.

In the first loop F9*a* the algorithm considers only tuples where the number of graphemes $n_g(g)$ and the number of phonemes $n_f(f)$ are equal, as, for example in the tuple "amazon=Ae m Heh z Heh n". In block F16 the tuples with $n_g(g)=n_f(f)$ are selected. A statistical model P(g|f) is initialised with a constant value, in block F17, or it can be initialised using pre-calculated statistics.

The lexicon alignment process iterates the application of a Dynamic Programming algorithm on the grapheme and phoneme sequences, where the distance metric is given by the probability that the grapheme g will be transcribed as the phoneme f, that is P(f|g). The calculation of P(f|g) is performed in block F18, for obtaining a P(f|g) model F19. The obtained statistical model F19 substitutes the statistical model F17 in the next step of the loop F9*a*. In block F20 it is checked if the model P(f|g) is stable; if it is not stable the process goes back to F18, otherwise it continues in block F23 of loop F9*b*.

The best alignment is the one with the maximum probability, that is:

$$BestPath = \underset{k}{\mathrm{Max}}\left(\prod_{i,j \in Path_k} p(f_i \mid g_j)\right)$$

where $Path_k$ is a generic alignment between grapheme and phoneme sequences. The probabilities P(f|g) are estimated during training at each iteration step. The previous statistical model is used as bootstrap model for the next step until the model itself is stable enough (block F20), for example a good metric is:

$$\left(\sum_{i,j} \mathrm{abs}\left(p(f_i \mid g_j)_{next} - p(f_i \mid g_j)_{previous}\right)\right) \leq THa. \qquad \text{(FRM1)}$$

where THa is a threshold that indicates the distance between the models. The value of FRM1 decreases in value until it reaches a relative minimum, then the value of FRM1 swings. The threshold THa can be estimated starting with a value equal to zero since FRM1 reach the minimum, then setting THa to a value equal to the mean of the first 10 swings of FRM1.

When the model is considered stable enough, this model is used, see block F23, as the bootstrap model for the next phase, block F24, in which is performed calculation of P(f|g) using the whole lexicon F15. Then it is checked if the model P(f|g) obtained in block F25 is stable, block F26, and if it is not stable the process goes back to block F24 using the model obtained in block F25 in block F23, otherwise it continues in block F29. Block F29 represents the stable model P(f|g).

The stable model P(f|g) is then used with the lexicon F15 for performing the lexicon alignment in block F30, obtaining an aligned lexicon F31.

In loop F9*b* the algorithm considers all the tuples in the lexicon, the statistical model is initialised with the last statistical model calculated during previous loop F9*a*.

The lexicon alignment process can be the same as explained before with reference to loop F9*a*, however other metrics and/or other thresholds can be chosen.

After the alignment of the lexicon, performed in block F9, we are able to consider, for every tuple, all the cases of grapheme/phoneme cancellation/insertion. Operation of blocks F10, F11, F13 in FIG. 3, in which some grapheme clusters and phoneme clusters are selected, will now be explained in detail with reference to the following example:

g1g2g3g4g5−g6 f1−f2f3f4f5f6

This can be the result of the F9*b* loop alignment for one word, where the gi are the graphemes (or grapheme clusters chosen in previous steps) and the fj the phonemes (or phoneme clusters chosen in previous steps) of the tupla.

The algorithm implemented in blocks F10-F11 calculates the possible clusters:

```
g1,g2        -> f1,
g2,g3        -> f2,
g1,g2,g3     -> f1,f2,
    g5       -> f4,f5,
    g6       -> f5,f6,
    g5,g6    -> f4,f5,f6,
and so on . . .
```

For each cluster present in the aligned lexicon, the algorithm calculates the number of the occurrences, buildings a table of occurrences.

If the occurrence of the most present grapheme/phoneme cluster is higher than the predetermined threshold (THR1 for grapheme clusters and THR2 for phoneme clusters), it is used to recompile the lexicon, block F13.

The algorithm therefore selects the most frequent cluster, and this cluster will be used for re-writing the lexicon.

By way of example, if the algorithm chooses the cluster g2,g3→f2, Each occurrence of g2,g3 in the lexicon will be re-written as g2+g3:

<g1g2+g3g4g5g6>=<f1f2f3f4f5f6>

In this case the number of the graphemes in the pair decreases, modifying future choices in the next F9*b* loop step.

The grapheme and phoneme clusters enlarge temporally the grapheme-set and the phoneme-set: in the example g2+g3 becomes temporally a member of the grapheme-set.

If there are no grapheme/phoneme clusters which mount is higher than the predetermined threshold, the first-step alignment algorithm ends, block F14.

Figure 5:
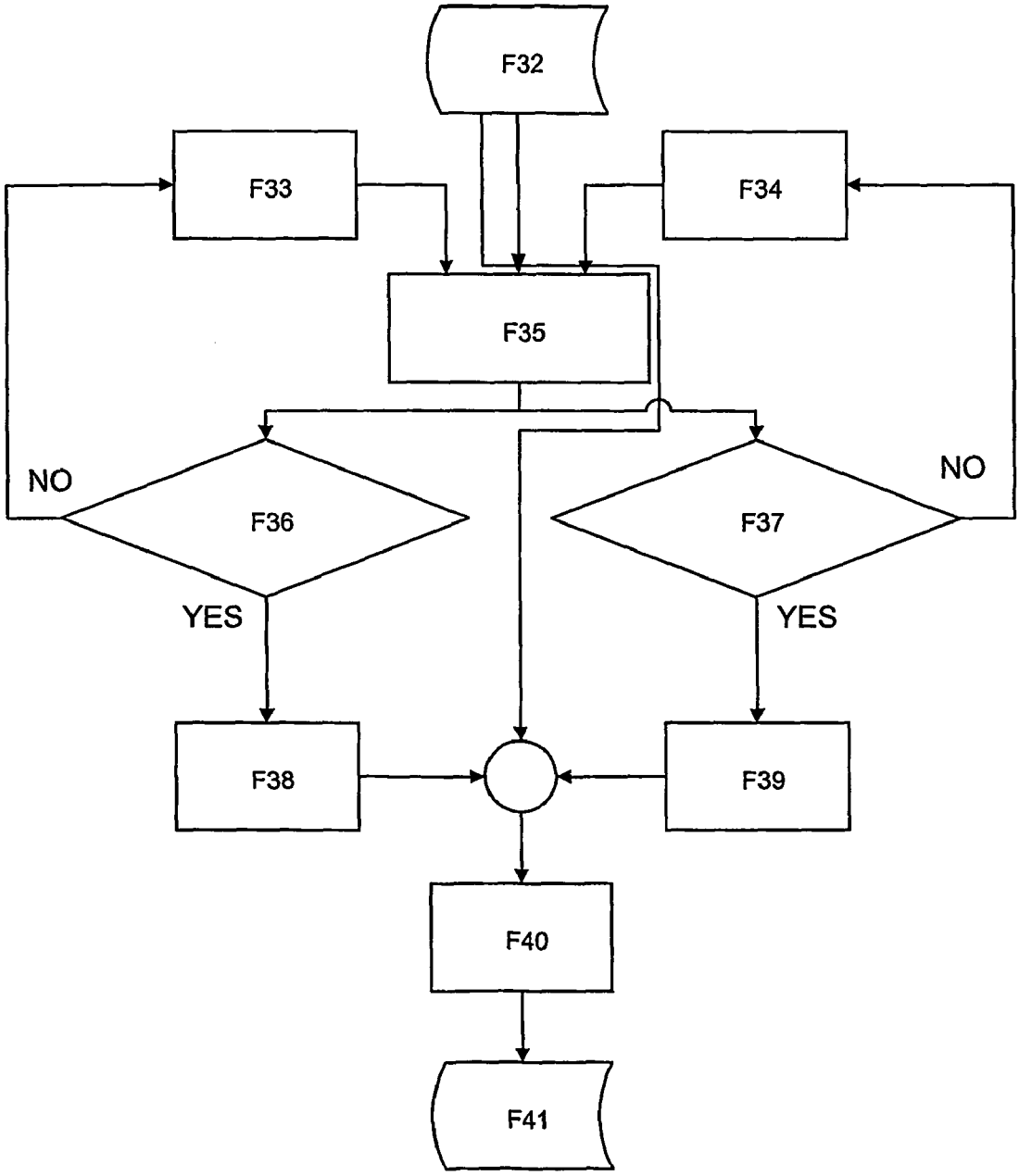
FIG. 5 is a block flow diagram of a grapheme-phoneme set enlargement step of the alignment method of FIG. 2.

FIG. 5 illustrates a flow diagram of the grapheme-set and phoneme-set enlargement step F2.

The alignment algorithm provides the grapheme and phoneme sets enlargement. It starts from the aligned lexicon F32.

In blocks F33 and F34 a pair of cluster thresholds is chosen, respectively a graphemic cluster threshold THR6 in block F33 and a phonemic cluster threshold THR7 in block F34.

The graphemic cluster threshold THR6 indicates the percentage of realizations that the graphemic cluster must achieve to be considered as potential element for the grapheme-set enlargement, while the phonetic cluster threshold THR7 indicates the percentage of realizations that the phonetic cluster must achieve to be considered as potential element for the phoneme-set enlargement.

The thresholds THR6 and THR7 are independent, and can be modified if the number of potential candidates exceeding the thresholds is too small, generally lower then a predetermined minimum number of graphemic clusters CN and phonetic clusters PN.

In block F35 the graphemic and phonetic clusters satisfying the thresholds THR6 and THR7 are selected, in block F36 it is verified if the desired number CN of graphemic clusters has been reached, while in block F37 it is verified if the desired number PN of phonetic clusters has been reached.

If required, it's possible to increase only one of the sets. The thresholds can be tuned in order to add more clusters. Experimental results have shown that thresholds around 80% are good for several languages. Lower thresholds can limit the subsequent extraction of good phonetic transcription rules.

If the desired number of graphemic and phonetic clusters has been obtained the corresponding grapheme and phoneme sets are enlarged permanently, respectively in blocks F38 and F39, and the lexicon F32 is rewritten, block 40, using the new grapheme and phoneme sets. The new, not-aligned, lexicon is obtained substituting the sequences of elements present in the lexicon with the grapheme and phoneme clusters chosen to enlarge the grapheme and phoneme sets.

The obtained lexicon, ready for a new alignment, is represented in FIG. 5 by block F41.

The following table shows an example of analysis of the aligned lexicon, wherein each cluster is associated to a percentage indicating its occurrence:

| Cluster | occurrence % |
|---|---|
| [0] g1 + g2 | 89.474% |
| [1] g2 + g3 | 41.753% |
| [2] g2 + g4 | 58.091% |
| [3] g1 + g2 + g3 | 29.492% |
| [4] g4 + g5 + g6 | 96.306% |
| [5] g2 + g2 | 97.660% |
| [6] g3 + g3 + g2 | 32.540% |
| [7] f1 + f2 + f3 | 33.482% |
| [8] f2 + f2 | 97.779% |
| [9] f4 + f5 + f4 | 99.667% |
| [10] f2 + f3 + f5 | 82.594% |
| [11] f1 + f1 | 30.301% |
| [12] f2 + f8 | 92.698% |

After the grapheme-set and phoneme-set enlargement step F2, the second alignment step F3 is performed, as previously described with reference to FIG. 2. The second step of the lexicon alignment process can be equal to the first step of alignment, however other metrics and/or other thresholds can be chosen.

The operation of the second alignment step F3 is the same as previously described with reference to FIG. 3, after an alignment step F9, the system calculates a statistical distribution of potential grapheme and phoneme clusters, for selecting, among said potential grapheme and phoneme clusters a cluster having highest occurrence. If such occurrence is higher then a threshold THR5, the lexicon is recompiled with the enlarged grapheme/phoneme sets, block F13, replacing each sequence of components corresponding to the sequence of components of the selected cluster with the selected cluster, and the process is reiterated starting from F8; otherwise the loop ends in block F14.

The grapheme-set/phoneme-set enlargement step F2 and the alignment algorithm F3 can be looped several times, until the obtained alignment is considered stable enough, depending on the intended use of the aligned lexicon.

The method and system according to the present invention can be implemented as a computer program comprising computer program code means adapted to run on a computer. Such computer program can be embodied on a computer readable medium.

The grapheme-to-phoneme transcription rules automatically obtained by means of the above described method and system, can be advantageously used in a text to speech system for improving the quality of the generated speech. The grapheme-to-phoneme alignment process is indeed intrinsically related to text-to-speech conversion, as it provides the basic toolset of grapheme-phoneme correspondences for use in predicting the pronunciation of a given word.

The invention claimed is:

1. A method of generating grapheme-to-phoneme rules for text-to-speech conversion based on a lexicon having words and phonetic transcriptions associated with the words, executed by a computer programmed to perform the method, the method comprising:

an alignment phase, using the computer, for aligning phonemes, belonging to a phoneme set, to graphemes, belonging to a grapheme set; and a rule-set extraction phase, using the computer, for generating a set of rules for automatic grapheme to phoneme conversion, said alignment phase comprising the following steps:

aligning said lexicon in a preliminary alignment step, using the computer, by generating a first plurality of grapheme and phoneme clusters, each cluster comprising a sequence of at least two components;

enlarging at least one of said phoneme and grapheme sets, using the computer, by adding at least one of the grapheme or phoneme clusters generated in said preliminary alignment step into at least one of the phoneme and grapheme sets;

rewriting said lexicon, using the computer, according to said at least one enlarged phoneme and grapheme sets;

aligning said lexicon in a further alignment step, using the computer, by generating a second plurality of phoneme and grapheme clusters; and the steps of:

a) selecting, using the computer, potential grapheme clusters whose occurrence is higher than a first predetermined threshold;

b) enlarging, using the computer, said grapheme set by adding said selected potential grapheme clusters;

c) selecting, using the computer, potential phoneme clusters whose occurrence is higher than a second predetermined threshold;

d) enlarging, using the computer, said phoneme set by adding said selected potential phoneme clusters; and e) rewriting, using the computer, said lexicon by replacing each sequence of components of corresponding grapheme and phoneme clusters in said lexicon with the selected potential grapheme and phoneme clusters, f) generating, using the computer, a lexicon alignment for said rule-set extraction phase in the further alignment step, and g) calculating, using the computer, a statistical distribution of the second plurality of grapheme and phoneme clusters generated in said further alignment step, and repeating, using the computer, said steps a) to f) in case a number of said grapheme and phoneme clusters generated in said further alignment step is greater than a third predetermined threshold.

2. The method according to claim 1, wherein said first predetermined threshold is equal to said second predetermined threshold.

3. The method according to claim 1, wherein said preliminary alignment step comprises:

a1) aligning, using the computer, a lexicon in a lexicon alignment step by generating the first plurality of grapheme and phoneme clusters, each cluster comprising a sequence of at least two components;

a2) calculating, using the computer, a statistical distribution of potential grapheme and phoneme clusters generated in said lexicon alignment step;

a3) selecting, using the computer, among said potential grapheme and phoneme clusters a cluster having highest occurrence; and a4) if said highest occurrence is higher than a third predetermined threshold, rewriting, using the computer, said lexicon by replacing each sequence of components of corresponding clusters in said lexicon with said selected cluster and repeating steps a1 to a4.

4. The method according to claim 3, wherein said potential grapheme and phoneme clusters are individuated searching all grapheme or phoneme cancellations or insertions.

5. The method according to claim 1, wherein said further alignment step comprises:

g1) aligning, using the computer, a lexicon in a lexicon alignment step by generating the second plurality of grapheme and phoneme clusters, each cluster comprising a sequence of at least two components;

g2) calculating, using the computer, a statistical distribution of potential grapheme and phoneme clusters generated in said lexicon alignment step;

g3) selecting, using the computer, among said potential grapheme and phoneme clusters a cluster having highest occurrence; and g4) if said highest occurrence is higher than a third predetermined threshold, rewriting, using the computer, said lexicon by replacing each sequence of components of corresponding clusters in said lexicon with said selected cluster and repeating steps g1 to g4.

6. The method according to claim 5, wherein said lexicon alignment step comprises:

h) generating, using the computer, a first statistical grapheme to phoneme association model having uniform probability;

i) selecting, using the computer, lexicon tuples having a total number of graphemes or grapheme clusters equal to a total number of phonemes or phoneme clusters;

j) aligning, using the computer, said tuples using said first statistical grapheme to phoneme association model;

k) recalculating, using the computer, said first statistical grapheme to phoneme association model using said aligned tuples;

l) if said recalculated model is not stable, repeating the step of aligning said tuples using said recalculated model and repeating the step of recalculating said model;

m) aligning, using the computer, the whole lexicon using said recalculated statistical grapheme to phoneme association model;

n) recalculating, using the computer, said statistical grapheme to phoneme association model using said whole lexicon; and o) if said recalculated model is not stable, repeating the step of aligning the whole lexicon using said recalculated model and repeating the step of recalculating said model using said whole lexicon.

7. The method according to claim 1, wherein said step of enlarging said grapheme set comprises:

c1) enlarging, using the computer, said grapheme set by adding said selected potential grapheme clusters if a number of said selected potential grapheme clusters is higher than a third predetermined threshold;

c2) lowering, using the computer, said third predetermined threshold; and, repeating steps a) and b) if the number of said selected potential grapheme clusters is lower than a predetermined number of grapheme clusters.

8. The method according to claim 1, wherein said step of enlarging said phoneme set comprises:

e1) enlarging, using the computer, said phoneme set by adding said selected potential phoneme clusters if a number of said selected potential phoneme clusters is higher than a third predetermined threshold; and e2) lowering, using the computer, said third predetermined threshold; repeating steps c) and d) if the number of said selected potential phoneme clusters is lower than a predetermined number of phoneme clusters.

9. The method according to claim 3, wherein said lexicon alignment step comprises:

h) generating, using the computer, a first statistical grapheme to phoneme association model having uniform probability;

i) selecting, using the computer, lexicon tuples having a total number of graphemes or grapheme clusters equal to a total number of phonemes or phoneme clusters;

j) aligning, using the computer, said tuples using said first statistical grapheme to phoneme association model;

k) recalculating, using the computer, said first statistical grapheme to phoneme association model using said aligned tuples;

l) if said recalculated model is not stable, repeating the step of aligning said tuples using said recalculated model and repeating the step of recalculating said model;

m) aligning, using the computer, the whole lexicon using said recalculated statistical grapheme to phoneme association model;

n) recalculating, using the computer, said statistical grapheme to phoneme association model using said whole lexicon; and o) if said recalculated model is not stable, repeating the step of aligning the whole lexicon using said recalculated model and repeating the step of recalculating said model using said whole lexicon.

m) aligning, using the computer, the whole lexicon using said recalculated statistical grapheme to phoneme association model;

n) recalculating, using the computer, said statistical grapheme to phoneme association model using said whole lexicon; and o) if said recalculated model is not stable, repeating the step of aligning the whole lexicon using said recalculated model and repeating the step of recalculating said model using said whole lexicon.

10. A non-transitory computer readable medium encoded with a computer program product, loadable into a memory of at least one computer, the computer program product comprising computer program code portions for performing all the steps of any one of claims 1, 2, and 3 to 6 when said program is run on the at least one computer.

11. A rule-set generating system for generating grapheme-to-Phoneme rules from a lexicon having words and their associated phonetic transcriptions, comprising a computer readable medium, the computer readable medium comprising:

an alignment unit, stored on the computer readable medium, for the assignment of phonemes to graphemes; and a rule-set extraction unit, stored on the computer readable medium, for generating a set of rules for automatic grapheme to phoneme conversion, wherein said alignment unit operates according to the method of claim 1.

12. A text to speech system for converting input text into an output acoustic signal, according to a set of rules for automatic grapheme to phoneme conversion generated by a rule-set generating system, said rule-set generating system comprising a computer readable medium, the computer readable medium comprising:

an alignment unit, stored on the computer readable medium, for the assignment of phonemes to graphemes; and a rule-set extraction unit, stored on the computer readable medium, for generating said set of rules, wherein said alignment unit operates according to the method of claim 1.

* * * * *